US006084147A

United States Patent [19]

Mason

[11] Patent Number: 6,084,147

[45] Date of Patent: Jul. 4, 2000

[54] PYROLYTIC DECOMPOSITION OF ORGANIC WASTES

[75] Inventor: J. Bradley Mason, Columbia, S.C.

[73] Assignee: Studsvik, Inc., Columbia, S.C.

[21] Appl. No.: 09/123,774

[22] Filed: Jul. 28, 1998

Related U.S. Application Data

[63] Continuation-in-part of application No. 08/680,380, Jul. 15, 1996, Pat. No. 5,909,654, which is a continuation-in-part of application No. 08/403,758, Mar. 17, 1995, Pat. No. 5,536, 896.

[51] Int. Cl.[7] ..... G21F 9/32

[52] U.S. Cl. ..... 588/19; 588/208; 588/233; 110/346

[58] Field of Search ..... 588/19, 208, 233; 110/346

[56] References Cited

U.S. PATENT DOCUMENTS

| | | | |
|---|---|---|---|
| 2,513,022 | 6/1950 | Helmers et al. . | |
| 2,539,466 | 1/1951 | Parry . | |
| 2,619,415 | 11/1952 | Hemminger . | |
| 2,633,416 | 3/1953 | Gornowski et al. . | |
| 2,680,065 | 6/1954 | Atwell . | |
| 2,683,657 | 7/1954 | Garbo . | |
| 2,772,954 | 12/1956 | Jequier . | |
| 2,979,390 | 4/1961 | Garbo . | |
| 3,522,019 | 7/1970 | Buswell et al. . | |
| 3,624,176 | 11/1971 | Lhonore et al. . | |
| 3,737,291 | 6/1973 | Lhonore et al. . | |
| 3,861,885 | 1/1975 | Schora . | |
| 3,966,634 | 6/1976 | Sacks . | |
| 4,053,432 | 10/1977 | Tiepel et al. . | |
| 4,259,910 | 4/1981 | Warren et al. . | |
| 4,292,048 | 9/1981 | Wesselhoft et al. . | |
| 4,309,198 | 1/1982 | Moss . | |
| 4,315,758 | 2/1982 | Patel et al. . | |
| 4,331,451 | 5/1982 | Isogaya et al. . | |
| 4,336,125 | 6/1982 | Weil et al. . | |
| 4,467,731 | 8/1984 | Di Fonzo | 110/235 |
| 4,555,361 | 11/1985 | Buckley et al. . | |
| 4,628,837 | 12/1986 | Mori et al. | 110/346 |
| 4,636,335 | 1/1987 | Kawamura et al. | 252/629 |
| 4,654,172 | 3/1987 | Matsuda et al. | 252/629 |
| 4,655,968 | 4/1987 | Queiser et al. | 252/632 |
| 4,699,632 | 10/1987 | Babu et al. | 48/197 R |
| 4,938,156 | 7/1990 | Yahata | 110/346 |
| 5,050,511 | 9/1991 | Hallett et al. | 110/346 |
| 5,059,404 | 10/1991 | Mansour et al. | 423/201 |
| 5,074,890 | 12/1991 | Schulz . | |
| 5,160,456 | 11/1992 | Lahn et al. | 252/373 |
| 5,325,797 | 7/1994 | Mei et al. | 110/245 |
| 5,470,544 | 11/1995 | Galloway | 422/213 |
| 5,471,937 | 12/1995 | Kosky et al. | 110/345 |
| 5,545,798 | 8/1996 | Elliott | 588/18 |
| 5,550,311 | 8/1996 | Young | 588/19 |

*Primary Examiner*—Ngoclan Mai
*Attorney, Agent, or Firm*—Horacio A. Farach; Michael A. Mann; Nexsen Pruet Jacobs and Pollard

[57] ABSTRACT

An organic waste decomposition system and method is described having two reaction vessels in tandem, each using superheated steam augmented by oxygen for decomposing a wide variety of organic compounds to reduce both mass and volume. Decomposition takes place quickly when a steam/oxygen mixture is injected into a fluidized bed of ceramic beads. The speed of the fluidizing gas mixture agitates the beads that then help to break up solid wastes, and the oxygen allows some oxidation to offset the thermal requirements of drying, pyrolysis, and steam reforming. Most of the pyrolysis takes place in the first stage, setting up the second stage for completion of pyrolysis and adjustment or gasification of the waste form using co-reactants to change the oxidation state of inorganics and using temperature to partition metallic wastes.

29 Claims, 1 Drawing Sheet

PYROLYTIC DECOMPOSITION OF ORGANIC WASTES

This application is a continuation-in-part of U. S. patent application Ser. No. 08/680,380, filed on Jul. 15, 1996, entitled "Method and Apparatus for the Volume Reduction and Processing of Nuclear Waste" by Rolf Hesböl and Bradley Mason now U.S. Pat. No. 5,909,654, which is itself a continuation-in-part of U.S. patent application Ser. No. 08/403,758, filed on Mar. 17, 1995, U.S. Pat. No. 5,536,896, entitled "Waste Processing" by Rolf Hesböl and Lars E. Holst, both of which applications being also assigned to the assignee of the present invention.

FIELD OF THE INVENTION

The present invention relates generally to decomposition of organic wastes. "Processing" refers to the breaking down of the wastes via a thermal route with the primary aim of affording an opportunity for reducing its volume to lessen handling and storage concerns. In particular, the present invention relates to pyrolysis of organic wastes.

BACKGROUND OF THE INVENTION

For decades, steam has been used to decompose organic chemicals, either to produce methane or to produce hydrogen and carbon monoxide and carbon dioxide as feed to other chemical processes. Because the basic process of steam reforming of organics is endothermic, much of the development in this art has focused on how best to meet the energy requirements. Typically, if external heat was not supplied, oxygen was added to the feedstock and thereby supply heat from exothermic oxidation. The apparatus for decomposing the waste also made use of the heat inherent in the effluents via heat exchange to preheat feedstock.

Other developments in steam reforming focused on fluidized bed reactors and catalysts for achieving greater efficiencies, especially in the production of synthetic gas as fuel.

The nuclear industry annually produces a significant amount of waste which is classified as radioactively contaminated ion exchange media, sludges and solvents. This waste is managed in various ways before being disposed of in bedrock chambers or by shallow land burial. Management of radioactive wastes is technically complex and, as a rule, leads to increased volumes that in turn increase storage costs. A process that results in reducing the volume and chemical reactivity of the waste disposed of is therefore highly desirable.

Ion exchange media is an organic material. The media base is usually a styrene polymer to which are grafted sulfonic acid and amine groups. The material is therefore burnable, but, when air is supplied during combustion, sulfur and nitrogen oxides are formed that in turn must be separated in some manner. Additionally, during combustion, the temperature becomes sufficiently high for radioactive cesium to be partially vaporized. The radioactivity of the burning resins could also accompany the resulting fly ash. This effect necessitates a very high performance filtration system. Accordingly, both technical and economic problems are typically associated with combustion of ion exchange media.

An alternative technique is pyrolysis. However, previously known pyrolysis methods in this field are deficient in several aspects and, in particular, no one has succeeded in devising a pyrolysis process that provides a comprehensive solution to the problem of sulfur and nitrogen-containing radioactive waste, and to do so under acceptable economic stipulations. See for example U.S. Pat. Nos. 5,424,042, 5,470,738, 5,427,738, 4,628,837, 4,636,335, and 4,654,172, and Swedish Patent SE-B 8405113-5.

Ion exchange media are not the only types of organic wastes generated by the nuclear industry, nor are they the only types of radioactive wastes generated by other industries. Some industries generate mixed wastes that include both radioactive waste and chemical wastes. The chemical wastes, for example, can include organic solvents such as trichloroethylene or PCBs. Mixed wastes are especially difficult to deal with because different and sometimes conflicting regulations apply to their dual hazards.

There is a need for a process that can efficiently decompose wastes containing radioactive contaminants and to do so in a way that reduces the volume and chemical reactivity of the waste residue remaining after decomposition.

SUMMARY OF THE INVENTION

According to its major aspects and briefly recited, the present invention is a method and apparatus for decomposing organic wastes using a two-stage steam-reformer. Wastes are fed into the first of the two stages along with a fluidizing gas composed of steam and oxygen. Both stages contain an inert media bed made of large, high-density beads, such as alumina beads up to 3000 microns in diameter. The fluidizing gases are injected at relatively high speeds, ranging up to 400 feet per second. In the first stage, the high speed gases pyrolyze much of the wastes at a temperature in the range of 450° to 800° C. and at a pressure of up to 45 pounds per square inch. Carbon and unpyrolyzed wastes are carried to the second stage from the first stage through a filter system.

In the second stage, pyrolysis continues under essentially the same conditions but the use of various co-reactants and judicious selection of temperatures can be made to affect the precise nature of the final waste form depending on the initial waste form entering the second stage. Waste gases are captured and treated in conventional ways, leaving an inorganic, high-metals content grit for disposal.

The use of two, back-to-back steam reformers is an important feature of the present invention. The bulk of the pyrolysis and steam reforming takes place in the first of the two allowing the second to be used not only to complete reformation but also to fine tune the final waste form.

The use of relatively high fluid velocities in connection with large bead-sized, high-density inert media in a fluidized bed reactor is another important feature of the present invention. The velocity of the fluidizing gas can be as high as 400 FPS and the beads made of alumina up to 3000 microns in diameter. The high velocities agitate the media so that it grinds the softer, friable feedstock, thus accelerating its exposure to the steam and its reformation. The action of the fluidizing medium on the bed material accelerates the pyrolysis and helps in some cases to prevent undesired reactions of feedstocks such as liquid sodium or organic explosives.

The use of co-reactants in the second stage to adjust the final waste form is another important feature of the present invention. For example, the oxidation state of metals such as chromium can be changed from the hazardous Cr+6 to the non-hazardous Cr+3 state. Reduction of hazardous sodium, calcium, magnesium and other metal salts to the corresponding cation oxide and/or carbonate is also advantageous. Addition of chloride or other co-reactants can be used to effectively partition certain metals such as zinc or cesium to the off gas. In this manner, the process can be used to remove high levels of cesium from high-level radioactive waste to produce concentrated cesium product that has a commercial value as well as low-activity radioactive waste that can be easily handled. The addition of carbon, together with sodium bearing wastes, can facilitate formation of high melting point sodium carbonates that can eliminate the formation of sodium eutectic salts that can melt and agglomerate the bed media. The addition of lime (calcium carbonate), together with phosphate bearing wastes, can facilitate the formation of stable calcium phosphate that can eliminate the corrosive phosphate ions in the system. Elimination or reduction of the amount of some waste forms that would otherwise require special handling may significantly reduce waste disposal costs.

Another feature of the present invention when applied to radioactive ion exchange resins is the low temperature at which the pyrolysis takes place. At lower temperatures, radioactive cesium remains with the residue rather than volatizing and entering the offgas system. By avoiding all but nominal cesium carryover to the offgas system, the need for a special cesium trap is avoided leaving conventional scrubbers to remove the small amount that does enter the offgas. In addition, if cesium and chlorides are present, zinc may be added to preferentially bond with the chloride and partition the resultant zinc chloride to the off gas, leaving the radioactive cesium in the waste residue.

Other features and their advantages will become apparent to those skilled in the art of organic waste disposal from a careful reading of the Detailed Description of Preferred Embodiments, accompanied by the following drawings.

DETAILED DESCRIPTION OF PREFERRED EMBODIMENTS

Figure 1:
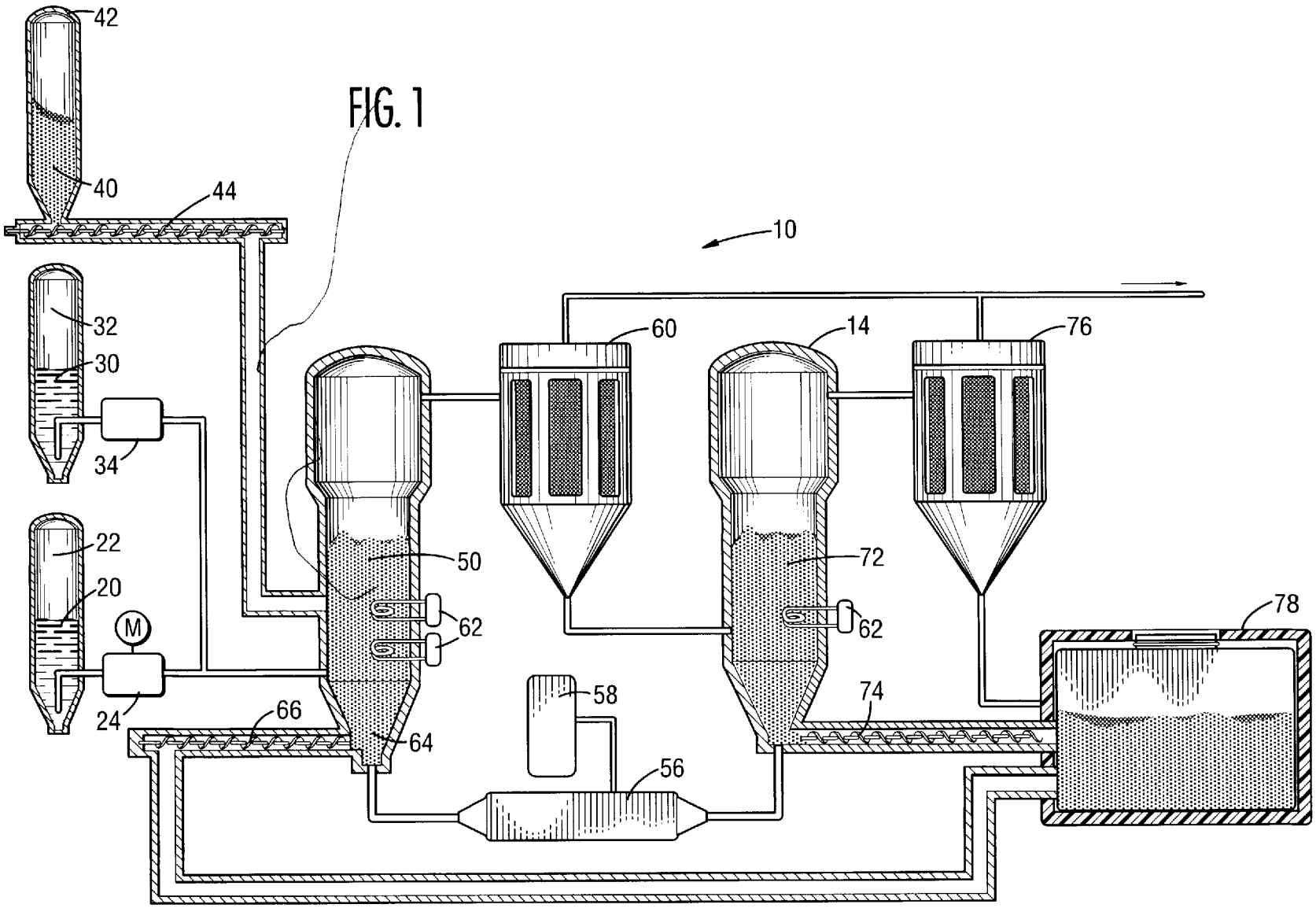
FIG. 1 is a schematic illustration of a system for decomposing organic wastes according to a preferred embodiment of the present invention.

The present invention is a decomposition process and system for decomposing organic wastes so that the volume and mass of the waste to be disposed of is greatly reduced from the initial volume and mass. Furthermore, those components of the processed waste that are released to the environment, gases and water vapor, are rendered harmless prior to release.

The present process will be described in particular with respect to radioactive waste, and most particularly with respect to radioactive ion exchange resin, but any organic wastes can be processed in accordance with the following process and with the components of the system.

The process is based on pyrolysis using steam supplemented with oxygen in a two-stage, fluidized bed reactor, and uses conventional off-gas treatment including wet scrubbers to treat the gaseous effluent. The solid residue from the processing of wastes, an inorganic, high-metal oxide content grit, is packaged for disposal or further treatment. The wastes that can be processed according to the present invention include not only ion exchange resins, but also steam generator cleaning solutions, solvents, oils, decontamination solutions, antifreeze, paper, plastics, cloth, wood, soils, sludge, nitrates, phosphates and contaminated waters.

An ion exchange resin is made of organic materials, commonly styrene to which are grafted amino groups to make anion resins or to which sulfonic groups are grafted to form cation resins. As these resins are used in a nuclear reactor, they accumulate up to about 7% iron, calcium, silica and minute amounts of other metals and cations.

Pyrolysis is the destruction of organic material using heat in the absence of a stoichiometric amount of oxygen. The presence of oxygen allows some oxidation to provide heat to offset the heat requirements of the pyrolysis or organic compounds, which is otherwise an endothermic reaction.

In the present process, the organic component of the resin is destructively distilled by the steam from the inorganic components. When heated, the weak chemical bonds of the resin polymers break up into compounds with lower carbon numbers, including carbon, metal oxides, and metal sulfides, and pyrolysis gases, which in turn include carbon dioxide, carbon monoxide, water, nitrogen and hydrocarbon gases, typically called syngas (carbon monoxide, hydrogen, methane, etc.). The small volume of solid residue remaining after reformation contains the overwhelming majority of the radionuclides. Although pyrolysis can take place over a wide range of temperatures, the present process is a low temperature pyrolysis, generally around 550–700° C. to prevent radioactive metals on the ion exchange resins from volatizing. These metals are retained in the reaction vessel residue. Consequently, the clean, low activity synthetic gases can then be converted at higher temperatures to carbon dioxide and water without concern for volatile radioactive metals such as cesium.

Referring now to FIG. 1, there is shown a system according to the present invention and generally indicated by reference number 10. System 10 includes two stages of steam reforming reaction vessels 12 and 14. Waste passes through vessel 12 first and then to vessel 14 except for volatile gases from vessel 12 that are forwarded to a conventional gas handling system (not shown). Ion exchange resin 20 is slurried from a resin tank 22 to first stage reaction vessel 12 for drying and pyrolysis. Other waste forms are delivered to the reformer in other ways. For example, solid waste 40 that have been size reduced by shredding, grinding or chopping are delivered from a solid waste vessel 42 by screw auger 44 to vessel 12. Liquids and gases 30 are simply pumped or injected from their container 32 using a pneumatic pump 34 for example.

In the first stage vessel 12, inert media 50 is used in the fluid bed. Media 50 is preferably silica or alumina, most preferably, amorphous alumina beads at least 200 and preferably up to 3000 microns in diameter, preferably between about 800 and 1300 microns. If acid gases are to be fed into the first stage, reactive media that will neutralize these gases is preferred, such as $Na_2CO_3$, CaO or $CaCO_3$ beads. These media are preferably made of a high density material to sustain a higher velocity of the fluidizing medium. Some choices of media will serve also as effective low cost catalysts for steam reforming, such as alumina beads.

If the feedstock includes nitrates, then coal, charcoal and/or sugar can be added to it to facilitate oxidation heating and to create a highly reducing environment for direct reduction of nitrates to nitrogen. The use of carbon creates a highly reducing hydrogen and carbon monoxide atmosphere that strips oxygen from nitrates.

The fluidizing medium can be an inert gas, but is preferably a reforming gas and an oxidizing gas in combination. Most preferably, the medium is superheated steam with oxygen. When the feedstock is aqueous, the steam content may accordingly be reduced and the oxygen content increased because of the increased heat requirements needed to evaporate the aqueous component of the waste. The fluidizing velocity can range from 1.0 feet per second or higher depending on the bed media, even as high as 400 FPS, preferably between about 1.25 and 5 FPS.

The high fluidizing medium speed has several advantages. High fluidizing medium speed in a vertically oriented bed agitates the bed media to help break down the softer, friable feed. It speeds decomposition; it helps to carry fine particulate from vessel 12.

The fluidizing medium can be distributed by any functionally appropriate design, however, for applications involving processing of radioactive wastes, distribution piping 56 is preferably made removable through the wall of first stage reactor vessel 12 so that it can be replaced or serviced without the need to remove the bottom of the vessel.

After first stage reforming in vessel 12, the effluent is filtered in a filter separator 60 to remove carbon, metal oxides, and other inorganic compounds from the volatile organic materials and excess steam.

The residue moving to the second stage reformer in reaction vessel 14 is again exposed to superheated steam to convert the fixed carbon to carbon monoxide that can then be exhausted to the offgas system.

As an example of the mass and volume reduction obtained with the present system, beginning with 4910 pounds of resin, the residue from the second stage reformer is 73 pounds for a weight reduction factor of 67.3 and a volume reduction factor of 61.4. Furthermore, by keeping the temperature of the pyrolysis below 700° C., the cesium carryover to the offgas system is held to less than 1%, which can be recovered using small, "polishing" ion exchangers on the scrubber water system rather than by incorporating more elaborate and expensive cesium traps.

For starting the pyrolysis in both first stage reaction vessel 12 and second stage reaction vessel 14, electrical heaters 62 are needed. Heaters 62 may be internal or external to the vessel. Once at or near temperature, the addition of oxygen to the fluidizing medium permits oxidation to take place and thereby obviates the need for excess external heat and increases throughput rates. Heat exchange through the vessel walls is also preferable to reduce the heating requirements.

In addition to oxygen injection and the use of electrical heaters 62 and heat exchange, co-reactants can be used to generate heat. These co-reactants can include coal, charcoal, methane, fuel oil, high-energy content wastes, etc.

The operating temperature is preferably 425° C. to 800° C. for decomposing most organics. For radioactive feedstocks, the upper end of the temperature range is preferably 700° C. to minimize corrosion, eutectic melting of salts, and the volatility of cesium, ntimony, technetium and ruthenium. The preferred pressure range is 10–45 psia, most referably 14–15 psia.

In operation, the high velocity, fluidizing medium entrains fine, light waste residues including metal oxides, ash and salts and carries them out the top of reaction vessel 12 along with syngas and carbon. Heavier wastes that are not pyrolyzed, such as gravel, metals and debris are removed from the bottom 64 of vessel 12. To facilitate this separation, high fluidizing velocities are used in combination with larger, more dense bed media. The fluidizing gases are injected at speeds of at least 1.0 FPS and up to 400 FPS, preferably about 300 FPS. Bed media are preferably 200–3000 microns in diameter and made of a metal oxide such as alumina, or perhaps silica. Except for attrition losses, the bed media 50 of vessel 12 remains in vessel 12. The larger bed media also help to break up particles of softer, more friable waste.

When wastes are removed from the bottom 64 of reaction vessel 12 of the first stage, the bed media 50 can frequently be separated from the waste residues and reused. Waste residues from the processing of ion exchange resins are primarily made of a magnetic form of metal oxide and therefore can generally be separated magnetically.

Depending on the waste form fed to the first stage, the output can include light organic compounds, carbon dioxide, carbon monoxide, hydrogen gas, fixed carbon in the form of char, metals, oxides and other inorganics, and water (steam).

After exiting the first stage reaction vessel 12, elutriated solids are removed from syngas by filter/separator 60. Filter/separator 60 is made of sintered metal or ceramic elements, and has a blowback capability to clean elements and heaters to assure that the temperature of filter/separator 60 is maintained above the dew point of the syngas stream. The solids collected by filter/separator 60 can be removed through the bottom 64 using cooled screw, lock valves or eductor and forwarded to second stage reaction vessel 14.

The carbon, unpyrolyzed organics and other solids are then injected to the second stage reaction vessel 14 along with superheated steam and optional oxygen. The carbon is gasified on contact with steam and oxygen in vessel 14, unpyrolyzed organics are pyrolyzed and inert solids are carried out of vessel 14. Almost all solid residues will be separated, as with the first stage 12, by filtration in a second filter/separator 76 and added to the first filter/separator 74 in a disposable container 78. The operating conditions of temperature and pressure for second stage reaction vessel 14 may be the same as for the first. Bed media 72 and fluidizing gas are the same. However, because the bulk of the pyrolysis has already taken place in the first stage, the second stage can be used for partitioning the residues or otherwise placing them in modified chemical final form.

For example, if nitrates are in the wastes received in the second stage, the presence of carbon in vessel 14 will reduce the nitrates to less harmful nitrogen gas, the nitrates dropping to less than 100 ppm at the gas outlet. Co-reactants introduced along with the fluidizing gas can be used to oxidize or reduce the wastes, changing an oxidation state to one that makes disposal more convenient, such as changing hazardous Cr+6 to non-hazardous Cr+3. This type of reaction is difficult to do in first reaction vessel 12 because the co-reactant may react with the excess steam or other pyrolysis gases. In reaction vessel 14, on the other hand, the processing can be more subtle.

Some metals will volatize at lower temperatures than others and may be separated by the operating temperatures of the second stage. Zinc for example may be separated from cesium, antimony and ruthenium simply by selection of an operating temperature higher than the temperature at which cadmium volatizes and lower than that at which the others volatize.

The second stage may also be operated as a calciner to convert $CaCO_3$ to CaO, $NaNO_3$ to $Na_2O$, and so on for use in the scrubbers of the offgas system.

The syngas from the first and second stages is directed to the gas handling system where the gases are conditioned in one of several ways, all of which employ conventional technology: volatile organic gases are oxidized, hot gases are cooled, acidic gases are scrubbed and converted to stable salts, excess water vapor is condensed and removed, and the cooled, scrubbed gases are filtered prior to release. Gases are monitored prior to release to assure that applicable environmental release requirements are met.

It will be apparent to those skilled in the art of decomposing wastes that many modifications and substitutions can be made to the preferred embodiments described above without departing from the spirit and scope of the present invention, which is defined by the appended claims.

What is claimed is:

1. A method for decomposing waste material contaminated with metal ions, said method comprising the steps of:

heating a reaction vessel containing a bed of inert beads to an operating temperature of at least 425° C. but below the volatilization temperature of metal ions in spent ion exchange resins;

co-injecting steam, co-reactant to alter the valance state of said metal ions and waste material into said reaction vessel so that substantially all of said waste material is pyrolyzed at said operating temperature and leave a metal oxide-rich inorganic residue that includes said metal ions.

2. The method as recited in claim 1, wherein said inert beads comprise amorphous alumina beads.

3. The method as recited in claim 1, further comprising the step of agitating said waste material in said reaction vessel to speed pyrolysis.

4. The method as recited in claim 1, wherein said steam is injected at a velocity that agitates said waste material.

5. The method as recited in claim 1, wherein said steam is injected into said reaction vessel at a velocity of at least 1.0 feet per second.

6. The method as recited in claim 1, wherein said reaction vessel contains a bed of alumina beads having a diameter of at least approximately 200 microns and said steam is injected at a velocity sufficient to fluidize said bed.

7. The method as recited in claim 1, wherein said reaction vessel contains a bed of alumina beads having a diameter of at least approximately 200 microns and said steam is injected at a velocity sufficient to agitate said beads in said bed.

8. The method as recited in claim 1, wherein said reaction vessel is provided with fluid gas distributors that can be removed without entering the vessel.

9. The method as recited in claim 1, further comprising the step of co-injecting oxygen into said reaction vessel.

10. The method as recited in claim 1, wherein said waste material is in solid form, liquid form, gaseous form or mixtures thereof.

11. A method for decomposing spent ion exchange resins contaminated with metal ions, said method comprising the steps of:

heating a first reaction vessel that contains a bed of inert beads to a first operating temperature;

heating a second reaction vessel that contains a bed of inert beads to a second operating temperature;

injecting steam and ion exchange resins into said first reaction vessel, said first reaction vessel having an output waste form; and injecting said output waste form of said first reaction vessel and steam into said second reaction vessel so that substantially all of said ion exchange resins are pyrolyzed and gasified and leave a metal oxide residue that includes said metal ions.

12. The method as recited in claim 11, wherein said inert beads comprise amorphous alumina beads.

13. The method as recited in claim 11, wherein said first and said second reaction vessels contain beads of alumina having a diameter of at least approximately 200 microns and said steam is injected at a speed of at least approximately 1.0 feet per second.

14. The method as recited in claim 11, wherein said first and second operating temperatures are less than 800° C.

15. The method as recited in claim 11, further comprises the step of injecting co-reactants into said second reaction vessel to alter the valence state of said output waste form of said first reaction vessel.

16. The method as recited in claim 11, wherein said output waste form is calcined in said second reaction vessel.

17. The method as recited in claim 11, wherein said first and second reaction vessels are provided with fluid gas distributors that can be removed without entering the vessels.

18. A method for processing radioactive wastes, said method comprising the steps of:

heating a first and a second reaction vessel containing media to a temperature greater than approximately 425° C. and less than approximately 800° C.;

injecting steam and oxygen into said first reaction vessel and injecting steam into said second reaction vessel at a speed sufficient to fluidize said bed of media;

injecting said wastes into said first reaction vessel whereby said wastes are at least partially pyrolyzed and produce elutrients;

filtering gaseous from solids contained in said elutrients of said first reaction vessel;

injecting said solids into said second reaction vessel to completely pyrolyze and gasify said radioactive wastes.

19. The method as recited in claim 18, wherein oxygen is also injected into said second reaction vessel.

20. The method as recited in claim 18, further comprising the step of injecting co-reactants into said second reaction vessel to change the oxidation step of said solids.

21. The method as recited in claim 18, further comprising the step of calcining said solids in said second reaction vessel.

22. The method as recited in claim 18, wherein said temperature of said first and said second reaction vessels is maintained below 650° C. to prevent radioactive cesium in said solids from volatizing.

23. The method as recited in claim 18, wherein said steam and oxygen are injected at a speed of at least 1.0 feet per second.

24. The method as recited in claim 18, wherein said temperature of said first reaction vessel is maintained below 550° C. and said temperature of said second reaction vessel is varied to partition metals in said solids.

25. The method as recited in claim 18, wherein said first and said second reaction vessels are maintained at a pressure between approximately 10 and 45 psia.

26. The method as recited in claim 18, wherein said media comprises alumina beads having a diameter of between 200 and 4000 microns.

27. The method as recited in claim 18, wherein the wastes contain phosphates and further comprising the step of adding a co-reactant to react with said phosphates to produce stable salts.

28. The method as recited in claim 18, wherein said media comprises amorphous alumina beads.

29. The method as recited in claim 18, wherein said first and second reaction vessels are provided with fluid gas distributors that can be removed without entering the vessels.

* * * * *